US008821114B2

(12) United States Patent
Afanasiev et al.

(10) Patent No.: US 8,821,114 B2
(45) Date of Patent: Sep. 2, 2014

(54) GAS TURBINE ENGINE SEALING STRUCTURE

(75) Inventors: Gennadiy Afanasiev, Windermere, FL (US); John N. Strain, Tequesta, FL (US); Robert W. Sunshine, Hobe Sound, FL (US); Robert D. Barker, Hobe Sound, FL (US)

(73) Assignee: Siemens Energy, Inc., Orlando, FL (US)

( * ) Notice: Subject to any disclaimer, the term of this patent is extended or adjusted under 35 U.S.C. 154(b) by 680 days.

(21) Appl. No.: 13/151,355

(22) Filed: Jun. 2, 2011

(65) Prior Publication Data

US 2011/0299978 A1 Dec. 8, 2011

Related U.S. Application Data

(60) Provisional application No. 61/351,414, filed on Jun. 4, 2010, provisional application No. 61/351,428, filed on Jun. 4, 2010.

(51) Int. Cl.
*F01D 11/00* (2006.01)

(52) U.S. Cl.
CPC ..... *F01D 11/005* (2013.01); *F05D 2250/292* (2013.01); *F05D 2260/30* (2013.01); *F05D 2240/11* (2013.01); *F05D 2250/314* (2013.01); *F05D 2250/192* (2013.01); *F05D 2230/642* (2013.01)
USPC ..... 415/170.1; 415/173.1

(58) Field of Classification Search
CPC ..... F01D 11/006; F01D 11/008; F05D 2250/292; F05D 2250/314; F05D 2250/192; F05D 2260/30
USPC ..... 415/170.1, 171.1, 173.3, 173.2, 173.4, 415/173.6, 173.7, 174.4; 277/641, 644, 631
See application file for complete search history.

(56) References Cited

U.S. PATENT DOCUMENTS

| | | | | |
|---|---|---|---|---|
| 3,970,318 | A | 7/1976 | Tuley | |
| 4,274,805 | A | 6/1981 | Holmes | |
| 4,379,560 | A | 4/1983 | Bakken | |
| 5,238,364 | A | 8/1993 | Kreitmeier | |
| 6,164,656 | A | 12/2000 | Frost | |
| 6,315,301 | B1 | 11/2001 | Umemura et al. | |
| 6,431,825 | B1 * | 8/2002 | McLean | 415/135 |
| 7,001,145 | B2 | 2/2006 | Couture et al. | |
| 7,094,025 | B2 | 8/2006 | Arness et al. | |
| 7,303,371 | B2 | 12/2007 | Tiemann | |
| 7,566,201 | B2 | 7/2009 | Brillert et al. | |
| 7,581,931 | B2 | 9/2009 | Shaefer et al. | |
| 2001/0019695 | A1 | 9/2001 | Correia | |
| 2002/0187040 | A1 | 12/2002 | Predmore | |
| 2003/0165381 | A1 | 9/2003 | Fokine et al. | |
| 2010/0074732 | A1 | 3/2010 | Marra et al. | |
| 2010/0237571 | A1 * | 9/2010 | Durocher et al. | 277/631 |

FOREIGN PATENT DOCUMENTS

| | | | |
|---|---|---|---|
| EP | 1291493 | A1 | 3/2003 |

* cited by examiner

*Primary Examiner* — Dwayne J White

(57) ABSTRACT

A turbine section having a plurality flow path components forming a plurality of guide vane rings and ring segments arranged in axial succession to define a boundary of a hot gas duct. A vane carrier located around the gas duct, and sealing elements extend radially between circumferentially extending grooves in the vane carrier and respective grooves in the flow path components. The sealing elements include radially inner and outer edges, and at least one axially facing side defining a chamfered portion extending to one of the edges to accommodate axial movement of the sealing element about the one edge within a respective groove.

15 Claims, 5 Drawing Sheets

FIG. 7
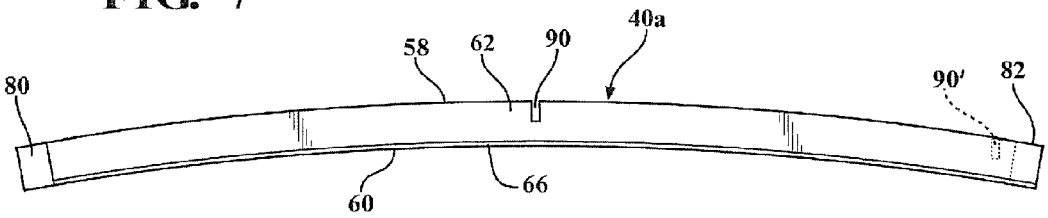
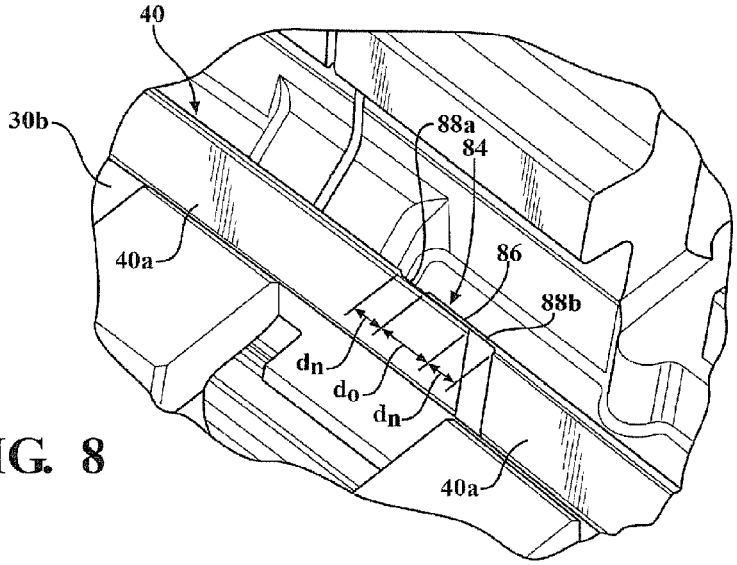
FIG. 8
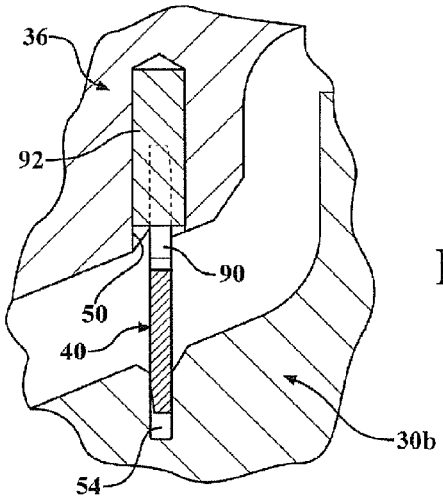
FIG. 9

GAS TURBINE ENGINE SEALING STRUCTURE

CROSS-REFERENCE TO RELATED APPLICATIONS

This application claims the benefit of U.S. Provisional Application No. 61/351,414 filed Jun. 4, 2010, and U.S. Provisional Application No. 61/351,428 filed Jun. 4, 2010, which are incorporated herein by reference.

FIELD OF THE INVENTION

The invention generally relates to axial flow gas turbine engines and, more particularly, to seals for preventing flow of gases in an axial direction through areas adjacent to a hot gas flow path.

BACKGROUND OF THE INVENTION

An axial gas turbine comprises a compressor section, a combustor section and a turbine section. In the compressor section, combustion air is compressed, and this compressed combustion air is then mixed and burned with fuel in the combustion section, forming a hot working gas. The hot gas which is formed is passed through a hot-gas duct in the turbine section. Guide vane rings and rotor blade rings or ring segments are arranged alternately in the turbine section. Flow path components comprising guide vanes and rotor blades are arranged adjacent to one another in the circumferential direction in each of these blade/vane rings.

The temperatures in an axial flow gas turbine reach levels which may exceed the melting points of the materials that are used for the components of the engine and/or reduce the hot strength of the materials to an unacceptable extent. For this reason, the components in the hot-gas duct are often cooled with a cooling medium. For example, air is generally branched off from the compressor to act as a cooling fluid to the turbine section components. The demand for cooling drops along the axial direction of flow in the hot-gas duct. Hence, cooling air at a lower pressure level than cooling air for front turbine stages is sufficient to cool rear turbine stages. To minimize the consumption of cooling air, since it reduces the efficiency of the gas turbine, the axially different turbine stages, i.e. the different blade/vane rings, are acted on by cooling air from different pressure levels. Thus, blade/vane rings which higher pressure than blade/vane rings lying further downstream in the direction of flow.

In view of the different supply pressures of cooling air to the adjacent blade/vane rings, it is desirable to form a seal between the different pressure levels in the axial direction. A seal is also desirable in order to prevent hot gas from being mixed into the cooling air and therefore to preserve the effectiveness of the cooling air.

SUMMARY OF THE INVENTION

In accordance with an aspect of the invention, an axial flow gas turbine engine arranged about a central axis. The gas turbine engine comprises a compressor section, a combustor section, and a turbine section. The turbine section has a plurality flow path components forming a plurality of guide vane rings and ring segments arranged in axial succession to define a boundary of a hot gas duct that contains a hot gas flow from the combustor section. The engine additionally includes a vane carrier and a sealing element including axially facing sides extending radially between a circumferentially extending groove in the vane carrier and a groove in the flow path components. The sealing element including radially inner and outer edges, and at least one of the axially facing sides defining a chamfered portion extending to one of the edges to accommodate axial movement of the sealing element about the one edge within a respective groove.

The chamfered portion may extend along the at least one axially facing side a distance greater than about 10% of the length of the sealing element.

The chamfered portion may comprise a first chamfered portion, and a second chamfered portion may be located at the opposite edge from the first chamfered portion. The first and second chamfered portions may be located on opposite axially facing sides. The first chamfered portion may be generally the same length as the second chamfered portion. The first and second chamfered portions may extend at an angle of about 5 degrees relative to a central longitudinal axis of the sealing element extending from the inner edge to the outer edge of the sealing element. Further, the first chamfered portion may be located on an upstream axially facing side of the sealing element at the inner edge; the second chamfered portion may be located on a downstream axially facing side of the sealing element at the outer edge; and the longitudinal axis of the sealing element may extend at an angle of about 5 degrees relative to a plane extending parallel to side walls defining the grooves, and the chamfered portions extend generally parallel to the side walls when the gas turbine is operating in a steady state condition.

The chamfered portion may extend at least about 45% of a radial extent of the respective groove.

The sealing element may be formed of a plurality of arcuate segments, and each arcuate segment may be engaged with adjacent arcuate segments in overlapping relationship at shiplap joints. Each shiplap joint may include non-overlapping portions to accommodate thermal expansion of the segments and including a centering mechanism on each segment to maintain an overlapping portion of each shiplap joint generally centered between respective non-overlapping portions during thermal expansion of the segments. The centering mechanism may comprise a notch formed in the outer edge of each segment, and may further include a pin extending radially inwardly within the groove in the vane carrier and engaged within the notch of the segment, the pin engaging the groove to effect positioning the segment at a predetermined circumferential location.

In accordance with a further aspect of the invention, an axial flow gas turbine engine sealing system is provided comprising a vane carrier having a circumferentially extending groove, and a flow path component ring defining a boundary of a hot gas duct and having a circumferentially extending groove. A sealing element is provided including axially facing sides extending radially between the groove of the vane carrier and the groove of the flow path component ring. The sealing element comprises a plurality of arcuate segments located in side-by-side relationship. Each of the segments of the sealing element is engaged with adjacent segments in overlapping relationship at shiplap joints.

Each shiplap joint may include non-overlapping portions to accommodate thermal expansion of the segments and may include a centering mechanism on each segment to maintain an overlapping portion of each shiplap joint generally centered between respective non-overlapping portions during thermal expansion of the segments. The centering mechanism may comprise a notch formed in the outer edge of each segment, and a pin extending radially inwardly within the groove in the vane carrier and engaged within the notch of the segment. The pin may engage the groove to effect positioning the segment at a predetermined circumferential location. The notch for at least one segment may be located adjacent to one of the shiplap joints for the segment, or the notch for at least one segment may be located at a mid-span location between the shiplap joints for the segment.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 7 is an elevation view of an axial face of a segment forming the sealing element;

FIG. 8 is a perspective view illustrating a shiplap joint formed between adjacent segments forming the sealing element; and FIG. 9 is a cross-sectional view illustrating a centering mechanism for locating a segment of the sealing element.

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
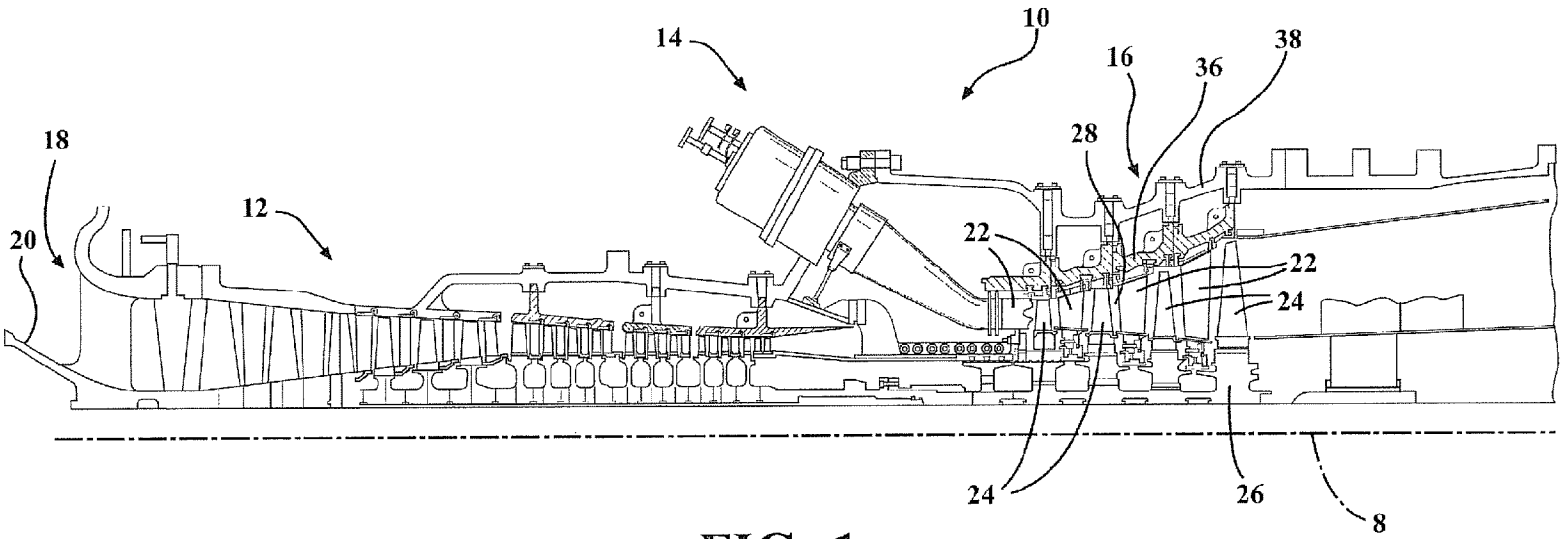
FIG. 1 is a partial cross-sectional view of a gas turbine engine that may incorporate a sealing structure formed in accordance with aspects of the present invention.

In FIG. 1, an axial flow gas turbine engine 10 is illustrated including a compressor section 12, a combustor section 14, and a turbine section 16 arranged about a central axis 8. The compressor section 12 compresses ambient air 18 that enters an inlet 20. The combustor section 14 combines the compressed air with a fuel and ignites the mixture creating combustion products comprising a hot working gas defining a working fluid. The working fluid travels to the turbine section 16. Within the turbine section 16 are rows of stationary vanes 22 and rows of rotating blades 24 coupled to a rotor 26, each pair of rows of vanes 22 and blades 24 forming a stage in the turbine section 16. The rows of vanes 22 and rows of blades 24 extend radially into an axial flow path 28 extending through the turbine section 16. The working fluid expands through the turbine section 16 and causes the blades 24, and therefore the rotor 26, to rotate. The rotor 26 extends into and through the compressor 12 and may provide power to the compressor 12 and output power to a generator (not shown).

Figure 2:
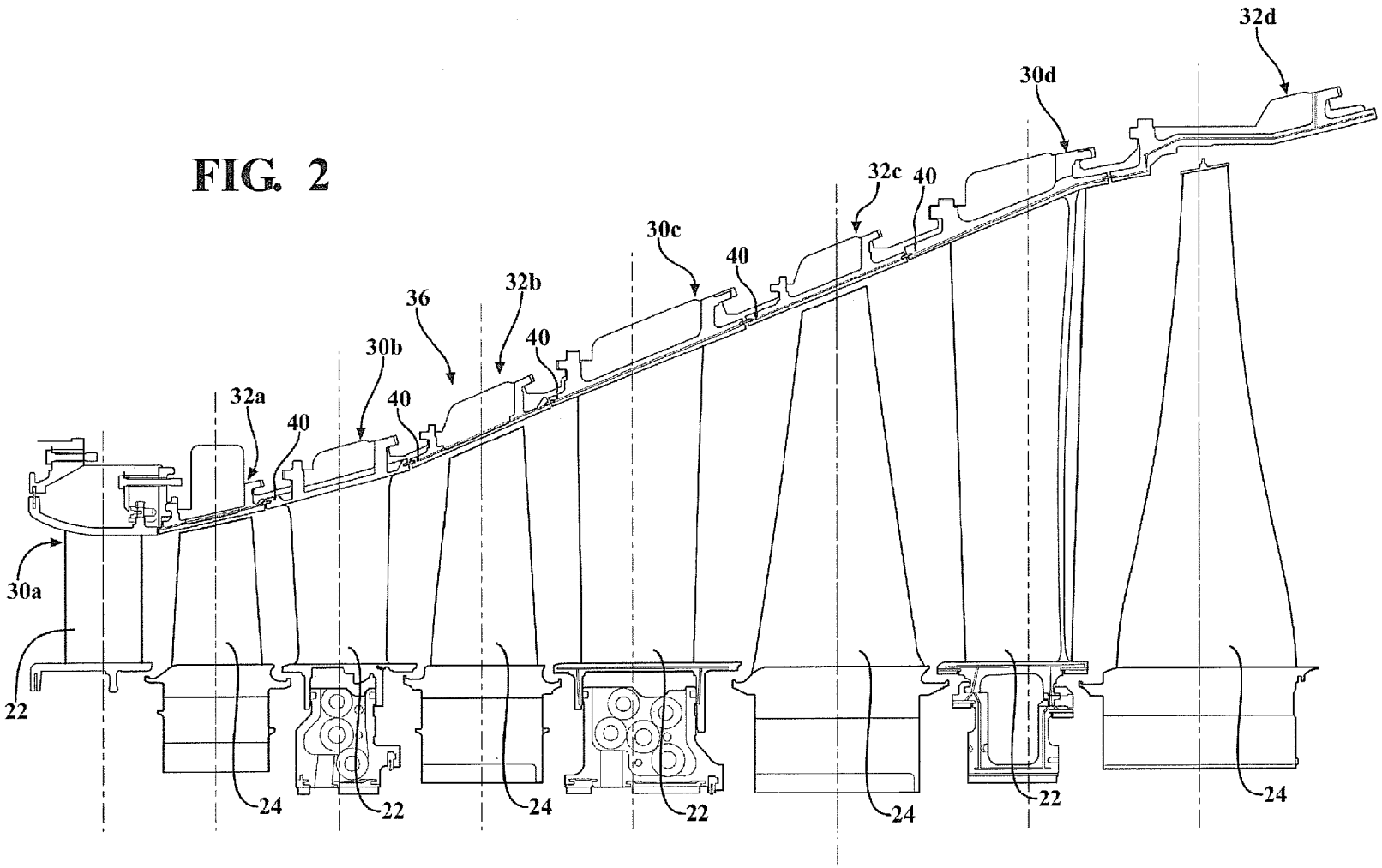
FIG. 2 is a cross-sectional view illustrating flow path components defining a boundary for a hot gas duct in the gas turbine engine.

Referring to FIG. 2, the turbine section 16 of the engine 10 is illustrated and includes a plurality of guide vane rings, formed by the rows of stationary vanes 22, arranged in axial succession with a plurality of ring segments, the ring segments defining a ring-shaped portion of the axial flow of the flow path 28 located radially outwardly from the blades 24. In particular, first through fourth guide vane rings 30*a-d* are located in alternating succession with first through fourth ring segments 32*a-d* to define a boundary for a hot gas duct forming the axial flow path 28 for containing the hot working gas from the combustor 14 section. The guide vane rings 30*a-d* and ring segments 32*a-d* are supported to a turbine vane carrier 36 within an outer casing 38 of the engine 10, see FIG. 1. Further, a sealing element comprising a vertical sealing element 40 is provided to each of the second through fourth guide vane rings 30*b-d* and to each of the second and third ring segments 32*b* and 32*c*, extending from the vane carrier 36 to the respective guide vane rings 30*b-d* and 32*b-c*.

Figure 3:
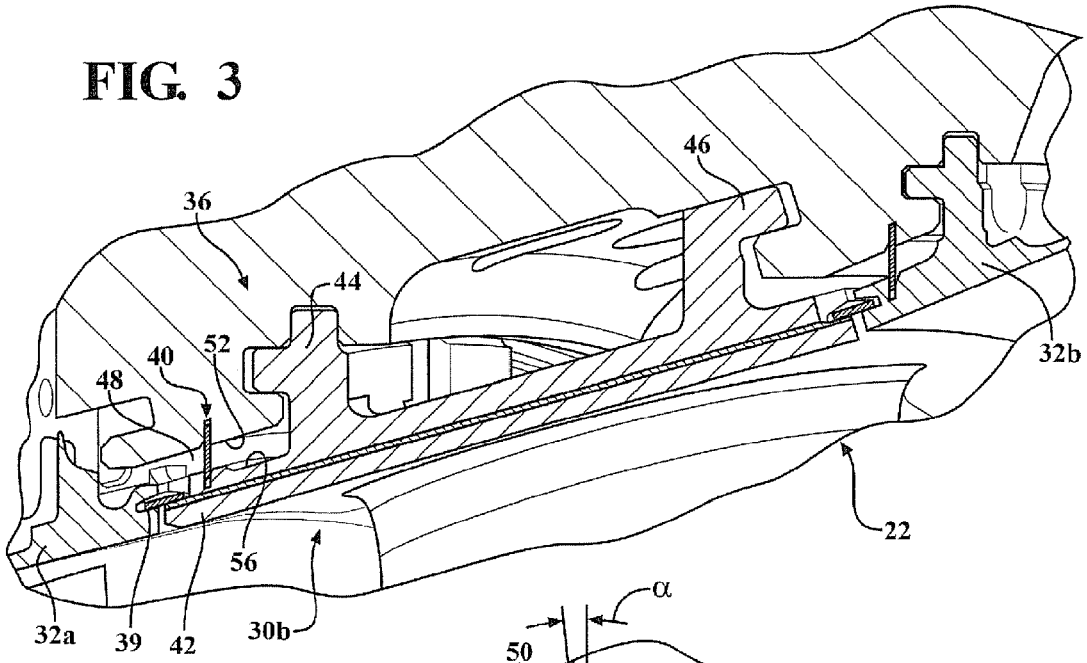
FIG. 3 is a cross-sectional view of a flow path component in FIG. 2 illustrating aspects of the present invention.

Referring to FIG. 3, the second row guide vane ring 30*b* and, in particular, a stationary vane 22 of the guide vane ring 30*b* is shown for illustrative purposes in describing one of the vertical sealing elements 40. It should be understood that the other vertical sealing elements 40 provided in the turbine section 16 may be of substantially the same construction as the sealing element 40 described below with reference to FIG. 3.

The vane 22 is supported to the vane carrier 36 by an upstream hook structure 44 and a downstream hook structure 46 engaged in corresponding recesses in the vane carrier 36. The sealing element 40 comprises a circumferentially extending structure extending radially from the vane carrier 36 to an axially forward location on an endwall 42 of the vane 22. The sealing element 40 is a sheet-like metal annular member that extends in a gap 48 between the vane carrier 36 and the guide vane ring 30*b* to prevent or limit an axial flow of gases through the gap 48 around substantially the entire circumference of the guide vane ring 30*b*. The sealing element 40 is preferably formed of a plurality of sealing element segments 40*a* (FIG. 5) located in side-by-side relationship, and each segment 40*a* may extend around a portion of the circumference of the engine 10 comprising an arc of about 20°, such that 18 of the segments 40*a* may form the sealing element 40.

The described sealing element 40 operates in combination with an axial seal 39 located between an axially forward edge of the endwall 42 and an axially rearward edge of the first ring segment 32*a* to substantially limit passage of gases axially through and radially into the gap 48 between the vane carrier 36 and the guide vane rings 30*a-d* and the ring segments 32*a-d*.

Figure 4:
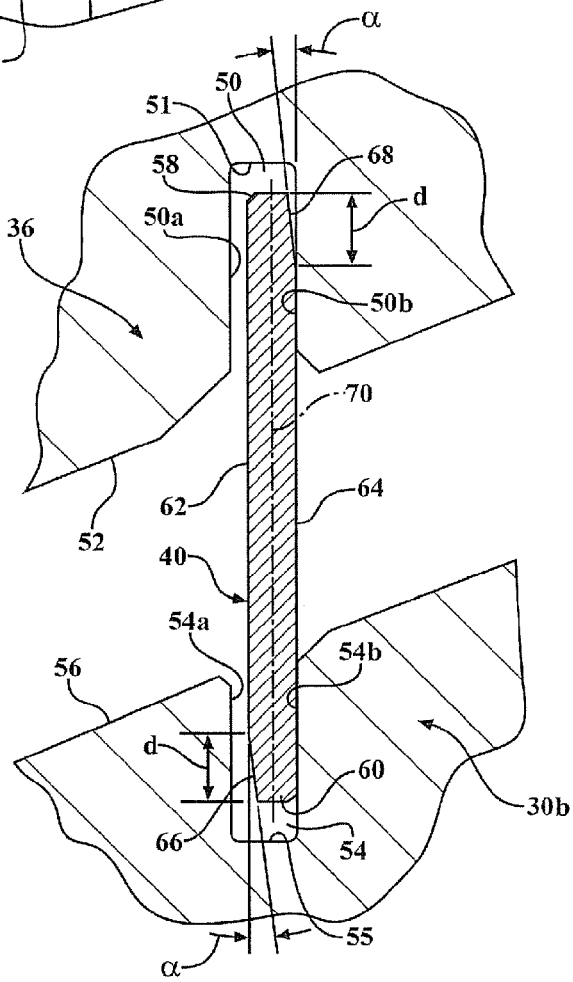
FIG. 4 is an enlarged view of a sealing element shown in FIG. 3.

Referring to FIG. 4, it can be seen that the vane carrier 36 comprises a circumferentially extending groove 50 defined by generally parallel outer groove side walls 50*a*, 50*b* extending radially outwardly from an inner surface 52 of the vane carrier 36 to an end surface 51. The endwall 42 illustrated for the guide vane ring 30*b* comprises a circumferentially extending groove 54 located generally opposite from the vane carrier groove 50, and defined by generally parallel groove side walls 54*a*, 54*b* extending radially inwardly from an outer surface 56 of the endwall 42 to an end surface 55. The sealing element 40 is positioned within a corridor defined between the grooves 50, 54, wherein the vane carrier groove 50 receives a radially outer edge 58 of the sealing element 40 and the guide vane ring groove 54 receives a radially inner edge 60 of the sealing element 40. The sealing element may have a radial dimension, between the outer and inner edges 58, 60, that is about 90% of the radial dimension of the corridor, defined between respective end surfaces 51, 55 of the grooves 50, 54, for allowing a limited radial movement of the sealing element 40.

The sealing element 40 includes opposing upstream and downstream axially facing sides 62, 64 that extend radially between the edges 58, 60 from the vane carrier groove 50 to the guide vane groove 54. At least one, and preferably both, of the axially facing sides 62, 64 is formed with a chamfered portion. In particular, the upstream axially facing side 62 may be formed with a first chamfered portion 66 extending to the radially inner edge 60, and the downstream axially facing side 64 may be formed with a second chamfered portion 68 extending to the radially outer edge 58. The chamfer portions 66, 68 are provided to accommodate movement of the sealing element 40 in the axial direction. In particular, the sealing element 40 is formed with a thickness between the axially facing sides 62, 64 that is less than the distance between the side walls 50*a*, 50*b* and less than the distance between the side walls 54*a*, 54*b*, such that an axial space is provided within each of the grooves 50, 54 for movement of the sealing element 40, i.e., pivoting movement, about the radially outer and inner edges 58, 60 within the respective grooves 50, 54. For example, the sealing element 40 may be formed with a thickness that is about 80% less than the spacing between the side walls 50*a*, 50*b* and/or the spacing between the side walls 54*a*, 54*b*.

The chamfered portions 66, 68 each extend along the respective axially facing sides 62, 64 a predetermined distance, d, equal to about 10% of the length of the sealing element 40, measured from the radially outer edge 58 to the radially inner edge 60, and the chamfered portions 66, 68 extend through the respective grooves 50, 54 a distance of at least about 45% of a radial extent of the grooves 50, 54. Further, the chamfered portions 66, 68 each extend at an angle, $\alpha$, of about 5 degrees relative to the respective axially facing sides 62, 64, i.e., relative to a central longitudinal axis 70 of the sealing element 40 extending from the radially outer edge 58 to the radially inner edge 60, to accommodate the axial movement of the sealing element 40.

Figure 5:
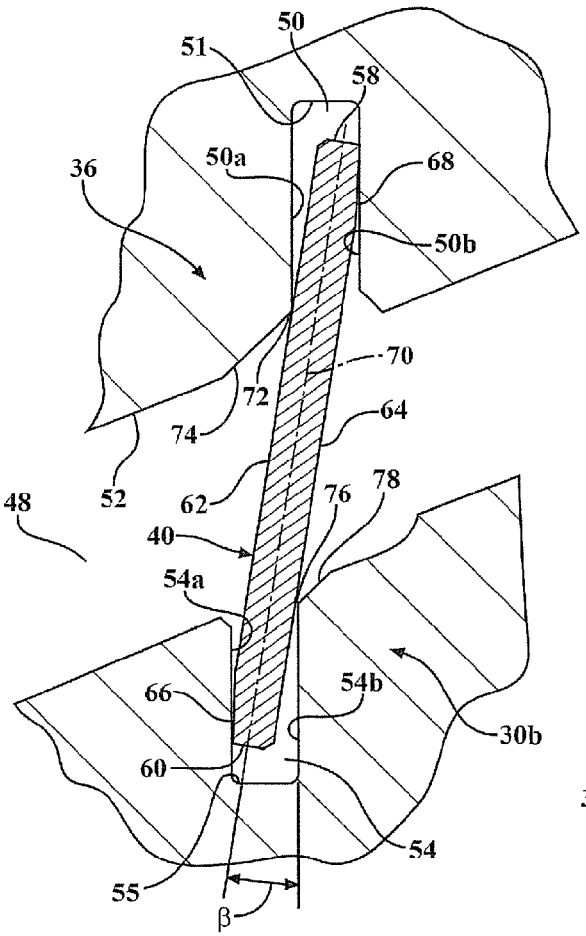
FIG. 5 is a view similar to FIG. 4 illustrating a position of the sealing element during a transient operation of the gas turbine engine.

Referring to FIG. 5, a position for the sealing element 40 relative to the vane carrier 36 and the guide vane ring 30*b* is illustrated, depicting a transient operation of the engine 10, such as may occur during a start-up of the engine prior to reaching steady state operation. During transient operation, the guide vane ring 30*b* may shift in a forward or upstream direction, as compared to a cold or non-operating position, such as is illustrated in FIG. 4. For example, due to axial pressure forces and/or thermal movement during transient operation, the guide vane ring 30*b* may shift forward. The sealing element 40 is shown pivoted within the grooves 50, 54 such that the radially outer edge 58 moves axially toward engagement with the side wall 50*b* and the radially inner edge 60 moves axially toward engagement with the side wall 54*a*. Further, the radially outer end of the sealing element 40 may be biased toward the side wall 50*b* by a radially inner edge 72 of the groove side wall 50*a* defined at a chamfered area 74 of the inner surface 52 of the vane carrier 36, and the radially inner end of the sealing element 40 may be biased toward the side wall 54*a* by a radially outer edge 76 of the groove side wall 54*b* defined at a chamfered area 78. During transient operation, the longitudinal axis 70 of the sealing element 40 may be angled relative to radially extending planes defined parallel to the side walls 50*a*, 50*b* and 54*a*, 54*b* at an angle, $\beta$, greater than 5 degrees, e.g., the sealing element 40 may be oriented at an angle of about 8 degrees. The chamfered portions 66, 68 along with chamfered areas 74, 78 provide additional clearance for movement of the sealing element 40 in the areas of the contact locations at the side walls 50*b*, 54*a* and at the edges 72, 76. The chamfered portions 66, 68 are particularly provided to reduce bending and associated stress fatigue that may be experienced by the sealing element 40 during transient operation.

Figure 6:
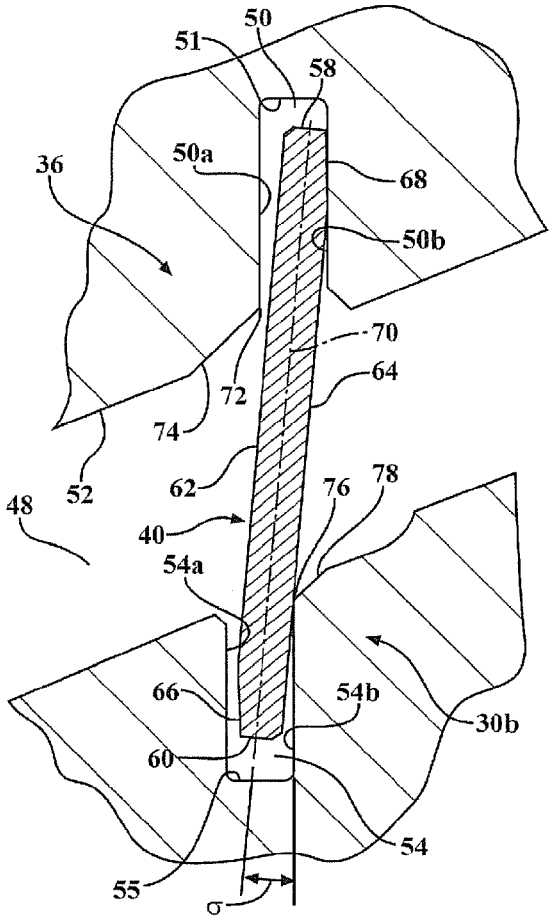
FIG. 6 is a view similar to FIG. 4 illustrating a position of the sealing element during a steady state operation of the engine.

Referring to FIG. 6, a position for the sealing element 40 relative to the vane carrier 36 and the guide vane ring 30*b* is illustrated, depicting a steady state operation of the engine 10, such as may occur when the engine is operating at base load. During steady state operation, the guide vane ring 30*b* may be displaced in a forward or upstream direction, as compared to a cold or non-operating position, such as is illustrated in FIG. 4, but is typically displaced less than during transient operation. In particular, the displacement of the groove 54 of the guide vane ring 30*b* relative to the groove 50 of the vane carrier 36 is such that the sealing element 40 is angled, i.e., relative to the plane of the side walls 50*a*, 50*b* and 54*a*, 54*b*, at an angle, $\sigma$, of about 5 degrees. Hence, the chamfered portions 66, 68 may be generally aligned parallel with the respective adjacent side walls 54*a*, 50*b*, which may facilitate preventing passage of gases through the gap 48. Further, the chamfered portions 66, 68 each provide a clearance for the sealing element 40 in the respective grooves 54, 50, permitting an axial movement of the sealing element to generally avoid bending of the sealing element 40 that may reduce stress and low cycle fatigue in the sealing element 40.

Referring to FIGS. 7 and 8, and as noted above, each of the segments 40*a* forming the sealing element 40 each comprise a portion of the circumferential extent of the sealing element 40. In order to prevent or limit passage of gases past the segments 40*a* at joints between adjacent segments 40*a*, each of the segments 40*a* includes a first shiplap portion 80 and a second shiplap portion 82 at ends thereof to form shiplap joints 84 (FIG. 8) where they adjoin and overlap an adjacent segment 40*a*. The thickness of the segment 40*a* at the shiplap portions 80, 82 is about one-half the thickness of the body of the segment 40*a*.

Referring to FIG. 8, the position of each of the segments 40*a* in a circumferential direction is controlled such that an overlapping portion 86 of each shiplap joint 84 is generally centered between non-overlapping portions 88*a*, 88*b* of the shiplap joint 84. As seen in FIG. 7, the segment 40*a* may be formed with a notch 90 for centering the segment 40*a*. In particular, the segment 40*a* may be circumferentially positioned or centered at a predetermined location by engagement of the notch 90 with a pin 92 affixed to the vane carrier 36 and extending radially inwardly within the vane carrier groove 50, as seen in FIG. 9. The non-overlapping portions 88*a*, 88*b* of the shiplap joints have a substantially equal dimension, $d_n$, on either side of the overlapping portion having a dimension, $d_o$, and accommodate thermal expansion of the segments 40*a* around the circumference of the sealing element 40. In a particular example, in a cold or as-installed state of the sealing element 40, the non-overlapping dimension, $d_n$, may be about 85% of the overlapping dimension, $d_o$; and in hot or operating state of the sealing element 40, the non-overlapping dimension, $d_n$, may be about 55% of the overlapping dimension, $d_o$. Hence, the engagement of the pin 92 with the notch 90 of the segment 40*a* comprises a centering or anti-rotation mechanism effective to maintain the predetermined circumferential position of each of the segments 40*a*, with the overlapping portion 86 of the shiplap joint 84 generally centered between the non-overlapping portions 88*a*, 88*b* during thermal expansion, and substantially evenly distributed, i.e., evenly dimensioned, overlapping portions 86 around the circumference of the sealing element 40, while also allowing the sealing element to move within the corridor defined between the grooves 50, 54.

It may be noted that the notch 90 may be located at a different position than the mid-span position depicted on the segment 40*a* shown in FIG. 7. For example, on the segments 40*a* at circumferential locations adjacent to the joints between the turbine casing halves forming the turbine casing, it may be desirable for the notch to be provided to the location depicted by notch 90' in FIG. 7, adjacent to one of the shiplap portions 80, 82. Such a location for the notch 90' may ensure that thermal expansion of the segment 40*a* substantially occurs in a direction extending from the notch 90' away from the casing half joint.

It should be understood that the preceding description is not limited to implementation with the particular guide vane ring 30*b* illustrated herein, in that the sealing element may preferably be provided to any, or all, of the flow path components comprising the other guide vane rings and ring segments of the turbine section 16. In particular, and without limitation, the sealing element 40 may preferably be provided to each of the second through fourth guide vane rings 30*b-d* and to each of the first through the third ring segments 32*a-c*.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An axial flow gas turbine engine arranged about a central axis, comprising:

a compressor section;

a combustor section;

a turbine section having a plurality flow path components forming a plurality of guide vane rings and ring segments arranged in axial succession to define a boundary of a hot gas duct that contains a hot gas flow from the combustor section;

a vane carrier; and a sealing element including axially facing sides extending radially between a circumferentially extending groove in the vane carrier and a groove in the flow path components, the sealing element including inner and outer ends extending into respective grooves and the ends terminating at radially inner and outer edges, and each of the axially facing sides defining a chamfered portion extending to a respective one of the edges to accommodate axial movement of the sealing element about the edges within the grooves; and each end of the sealing element includes an axially facing parallel side and an opposing chamfered side defined by a respective chamfered portion, wherein:

a) the chamfered portion of the inner end is formed by an upstream axially facing side oriented at an angle to a central longitudinal axis of the sealing element, the central longitudinal axis extending from the inner edge to the outer edge of the sealing element, and the parallel side of the inner end is formed by a downstream axially facing side oriented parallel to the central longitudinal axis; and b) the chamfered portion of the outer end is formed by a downstream axially facing side oriented at an angle to the central longitudinal axis of the sealing element, and the parallel side of the outer end is formed by an upstream axially facing side oriented parallel to the central longitudinal axis.

2. The gas turbine of claim 1, wherein the chamfered portions extend along respective axially facing sides a distance greater than about 10% of the length of the sealing element.

3. The gas turbine of claim 1, wherein the chamfered portion at the inner end is generally the same length as the chamfered portion at the outer end.

4. The gas turbine of claim 3, wherein the chamfered portions at the inner and outer ends each extend at an angle of about 5 degrees relative to the central longitudinal axis of the sealing element.

5. The gas turbine of claim 4, wherein the longitudinal axis of the sealing element extends at an angle of about 5 degrees relative to a plane extending parallel to side walls defining the grooves, and the chamfered portions extend generally parallel to the side walls when the gas turbine is operating in a steady state condition.

6. The gas turbine engine of claim 1, wherein each chamfered portion extends at least about 45% of a radial extent of a respective groove.

7. The gas turbine of claim 1, wherein the sealing element is formed of a plurality of arcuate segments, and each arcuate segment is engaged with adjacent arcuate segments in overlapping relationship at shiplap joints.

8. The gas turbine of claim 7, wherein each shiplap joint includes non-overlapping portions to accommodate thermal expansion of the segments and including a centering mechanism on each segment to maintain an overlapping portion of each shiplap joint generally centered between respective non-overlapping portions during thermal expansion of the segments.

9. The gas turbine of claim 8, wherein the centering mechanism comprises a notch formed in the outer edge of each segment, and a pin extending radially inwardly within the groove in the vane carrier and engaged within the notch of the segment, the pin engaging the groove to effect positioning the segment at a predetermined circumferential location.

10. An axial flow gas turbine engine sealing system, comprising:

a vane carrier having a circumferentially extending groove;

a flow path component ring defining a boundary of a hot gas duct and having a circumferentially extending groove;

a sealing element including axially facing sides extending radially between the groove of the vane carrier and the groove of the flow path component ring, the sealing element comprising a plurality of arcuate segments located in side-by-side relationship;

each of the segments of the sealing element engaged with adjacent segments in overlapping relationship at shiplap joints; and wherein each shiplap joint includes non-overlapping portions to accommodate thermal expansion of the segments and including a centering mechanism on each segment to maintain an overlapping portion of each shiplap joint generally centered between respective non-overlapping portions during thermal expansion of the segments.

11. The sealing system of claim 10, wherein the centering mechanism comprises a notch formed in the outer edge of each segment, and a pin extending radially inwardly within the groove in the vane carrier and engaged within the notch of the segment, the pin engaging the groove to effect positioning the segment at a predetermined circumferential location.

12. The sealing element of claim 11, wherein the notch for at least one segment is located adjacent to one of the shiplap joints for the segment.

13. The sealing element of claim 11, wherein the notch for at least one segment is located at a mid-span location between the shiplap joints for the segment.

14. The sealing system of claim 10, including first and second chamfered portions located on opposing axially facing sides of the sealing element at respective radially outer and inner edges of the sealing element.

15. The sealing system of claim 14, wherein the first and second chamfered portions extend at least about 45% of a radial extent of the respective grooves receiving the outer and inner edges of the sealing element.

* * * * *